US008370133B2

(12) United States Patent
Taleb et al.

(10) Patent No.: US 8,370,133 B2
(45) Date of Patent: Feb. 5, 2013

(54) METHOD AND DEVICE FOR NOISE FILLING

(75) Inventors: Anisse Taleb, Kista (SE); Manuel Briand, Djursholm (SE); Gustaf Ullberg, Stockholm (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 528 days.

(21) Appl. No.: 12/675,290

(22) PCT Filed: Aug. 26, 2008

(86) PCT No.: PCT/SE2008/050968

§ 371 (c)(1),
(2), (4) Date: Feb. 25, 2010

(87) PCT Pub. No.: WO2009/029036

PCT Pub. Date: Mar. 5, 2009

(65) Prior Publication Data

US 2010/0241437 A1 Sep. 23, 2010

Related U.S. Application Data

(60) Provisional application No. 60/968,230, filed on Aug. 27, 2007.

(51) Int. Cl.
*G10L 19/00* (2006.01)

(52) U.S. Cl. ..... 704/201; 704/500; 704/501; 704/502; 704/503

(58) Field of Classification Search ..... 704/201, 704/500–504
See application file for complete search history.

(56) References Cited

U.S. PATENT DOCUMENTS

| | | | |
|---|---|---|---|
| 2003/0187663 | A1 | 10/2003 | Truman et al. |
| 2003/0233234 | A1 | 12/2003 | Truman et al. |
| 2005/0267739 | A1 | 12/2005 | Kontio et al. |
| 2006/0265087 | A1 | 11/2006 | Philippe et al. |
| 2007/0041324 | A1 | 2/2007 | Shenoi |

FOREIGN PATENT DOCUMENTS

| | | | |
|---|---|---|---|
| WO | 9116769 | A1 | 10/1991 |
| WO | 03107329 | A1 | 12/2003 |
| WO | 2005078706 | A1 | 8/2005 |
| WO | 2006107840 | A1 | 10/2006 |

OTHER PUBLICATIONS

Supplementary European Search Report issued in in International application No. PCT/SE2008/050968 on Nov. 28, 2011, 9 pages.

*Primary Examiner* — Justin Rider
(74) *Attorney, Agent, or Firm* — Rothwell, Figg, Ernst & Manbeck, P.C.

(57) ABSTRACT

A method for perceptual spectral decoding comprises decoding of spectral coefficients recovered from a binary flux into decoded spectral coefficients of an initial set of spectral coefficients. The initial set of spectral coefficients are spectrum filled. The spectrum filling comprises noise filling of spectral holes by setting spectral coefficients in the initial set of spectral coefficients not being decoded from the binary flux equal to elements derived from the decoded spectral coefficients. The set of reconstructed spectral coefficients of a frequency domain formed by the spectrum filling is converted into an audio signal of a time domain. A perceptual spectral decoder comprises a noise filler, operating according to the method for perceptual spectral decoding.

22 Claims, 8 Drawing Sheets

METHOD AND DEVICE FOR NOISE FILLING

CROSS REFERENCE TO RELATED APPLICATION(S)

This application is a 35 U.S.C. §371 National Phase Entry Application from PCT/SE2008/050968, filed Aug. 26, 2008, and designating the United States. This application also claims the benefit of U.S. Application No. 60/968,230 filed Aug. 27, 2007, the disclosures of which is incorporated herein in its entirety by reference.

TECHNICAL FIELD

The present invention relates in general to methods and devices for coding and decoding of audio signals, and in particular to methods and devices for perceptual spectral decoding.

BACKGROUND

When audio signals are to be stored and/or transmitted, a standard approach today is to code the audio signals into a digital representation according to different schemes. In order to save storage and/or transmission capacity, it is a general wish to reduce the size of the digital representation needed to allow reconstruction of the audio signals with sufficient perceptual quality. The trade-off between size of the coded signal and signal quality depends on the actual application.

A time domain signal has typically to be divided into smaller parts in order to precisely encode the evolution of the signal's amplitude, i.e. describe with low amount of information. State-of-the-art coding methods usually transform the time-domain signal into the frequency domain where a better coding gain can be reached by using perceptual coding i.e. lossy coding but ideally unnoticeable by the human auditory system. See e.g. J. D. Johnston, "Transform coding of audio signals using perceptual noise criteria", IEEE J. Select. Areas Commun., Vol. 6, pp. 314-323, 1988 [1]. However, when the bit rate constraint is too strong, the perceptual audio coding concept can not avoid the introduction of distortions, i.e. coding noise over the masking threshold. The general issue of reducing distortions in perceptual audio coding has been addressed by the Temporal Noise Shaping (TNS) technology described in e.g. J. Herre, "Temporal Noise Shaping, Quantization and Coding Methods in Perceptual Audio Coding: A tutorial introduction", AES 17th Int. conf. on High Quality Audio Coding, 1997 [2]. Basically, the TNS approach is based on two main considerations, namely the consideration of the time/frequency duality and the shaping of quantization noise spectra by means of open-loop predictive coding.

In addition, audio coding standards are continuously designed in order to deliver high or intermediate audio quality, from narrowband speech to fullband audio, at low data rates for a reasonable complexity according to the dedicated application. The Spectral Band Replication (SBR) technology, described in 3GPP TS 26.404 V6.0.0 (2004-09), "Enhanced aacPlus general audio codec—encoder SBR part (Release 6)", 2004 [3], has been introduced to allow wideband or fullband audio coding at low data rate by associating specific parameters to the binary flux resulting from perceptual audio coding of the narrow band signal. Such specific parameters are typically used at the decoder side to re-generate the missing high-frequencies that is not decoded by the core codec from the low-frequency decoded spectrum.

The association of TNS and SBR technologies, described in [3], in a transform based audio codec has been successfully implemented for intermediate data rate applications, i.e. a typical bit rate of 32 kbps for intermediate audio quality. Nevertheless, these highly sophisticated coding methods are very complex since they involve predictive coding and adaptive-resolution filter bank requiring certain delays. They are indeed not well appropriated for low delay and low complexity applications.

SUMMARY

A general object of the present invention is thus to provide methods and devices for reducing coding artifacts, applicable also at low bit rates. A further object of the present invention is also to provide methods and devices for reducing coding artifacts having a low complexity.

The above mentioned objects are achieved by methods and devices according to the enclosed patent claims. In general words, in a first aspect, a method for perceptual spectral decoding comprises decoding of spectral coefficients recovered from a binary flux into decoded spectral coefficients of an initial set of spectral coefficients. The initial set of spectral coefficients is spectrum filled into a set of reconstructed spectral coefficients. The spectrum filling comprises noise filling of spectral holes by setting spectral coefficients in the initial set of spectral coefficients not being decoded from the binary flux equal to elements derived from the decoded spectral coefficients. The set of reconstructed spectral coefficients of a frequency domain is converted into an audio signal of a time domain.

In a second aspect, a method for signal handling in perceptual spectral decoding comprises obtaining of decoded spectral coefficients of an initial set of spectral coefficients. The initial set of spectral coefficients is spectrum filled into a set of reconstructed spectral coefficients. The spectrum filling comprises noise filling of spectral holes by setting spectral coefficients in the initial set of spectral coefficients having a zero magnitude or being non-coded equal to elements derived from the decoded spectral coefficients. The set of reconstructed spectral coefficients is outputted.

In a third aspect, a perceptual spectral decoder comprises an input for a binary flux and a spectral coefficient decoder arranged for decoding spectral coefficients recovered from the binary flux into decoded spectral coefficients of an initial set of spectral coefficients. The perceptual spectral decoder further comprises a spectrum filler connected to the spectral coefficient decoder and arranged for spectrum filling of the set of spectral coefficients. The spectrum filler comprises a noise filler for noise filling of spectral holes by setting spectral coefficients in the initial set of spectral coefficients not being decoded from the binary flux equal to elements derived from the decoded spectral coefficients. The perceptual spectral decoder also comprises a converter connected to the spectrum filler and arranged for converting the set of reconstructed spectral coefficients of a frequency domain into an audio signal of a time domain and an output for the audio signal.

In a fourth aspect, a signal handling device for use in a perceptual spectral decoder comprises an input for decoded spectral coefficients of an initial set of spectral coefficients and a spectrum filler connected to the input and arranged for spectrum filling of the initial set of spectral coefficients. The spectrum filler comprises a noise filler for noise filling of spectral holes by setting spectral coefficients in the initial set of spectral coefficients having a zero magnitude or being non-decoded equal to elements derived from the decoded spectral coefficients. The signal handling device also comprises an output for the set of reconstructed spectral coefficients.

One advantage with the present invention is that an original signal temporal envelope of an audio signal is better preserved since noise filling relies on the decoded spectral coefficients without injection of random noise as it occurs in conventional noise filling methods. The present invention is also possible to implement in a low-complexity manner. Other advantages are further discussed in connection with the different embodiments described further below.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the drawings, the same reference numbers are used for similar or corresponding elements.

The present invention relies on a frequency domain processing at the decoding side of a coding-decoding system. This frequency domain processing is called Noise Fill (NF), which is able to reduce the coding artifacts occurring particularly for low bit-rates and which also may be used to regenerate a full bandwidth audio signal even at low rates and with a low complexity scheme.

Figure 1:
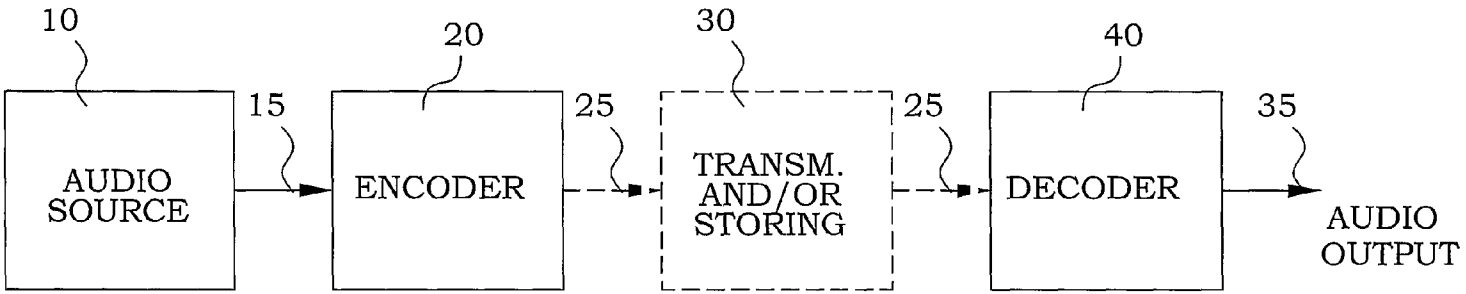
FIG. 1 is a schematic block scheme of a codec system.

An embodiment of a general codec system for audio signals is schematically illustrated in FIG. 1. An audio source 10 gives rise to an audio signal 15. The audio signal 15 is handled in an encoder 20, which produces a binary flux 25 comprising data representing the audio signal 15. The binary flux 25 may be transmitted, as e.g. in the case of multimedia communication, by a transmission and/or storing arrangement 30. The transmission and/or storing arrangement 30 optionally also may comprise some storing capacity. The binary flux 25 may also only be stored in the transmission and/or storing arrangement 30, just introducing a time delay in the utilization of the binary flux. The transmission and/or storing arrangement 30 is thus an arrangement introducing at least one of a spatial repositioning or time delay of the binary flux 25. When being used, the binary flux 25 is handled in a decoder 40, which produces an audio output 35 from the data comprised in the binary flux. Typically, the audio output 35 should approximate the original audio signal 15 as well as possible under certain constraints, e.g. data rate, delay or complexity.

In many real-time applications, the time delay between the production of the original audio signal 15 and the produced audio output 35 is typically not allowed to exceed a certain time. If the transmission resources at the same time are limited, the available bit-rate is also typically low. In order to utilize the available bit-rate in a best possible manner, perceptual audio coding has been developed. Perceptual audio coding has therefore become an important part for many multimedia services today. The basic principle is to convert the audio signal into spectral coefficient in a frequency domain and using a perceptual model to determine a frequency and time dependent masking of the spectral coefficients.

Figure 2:
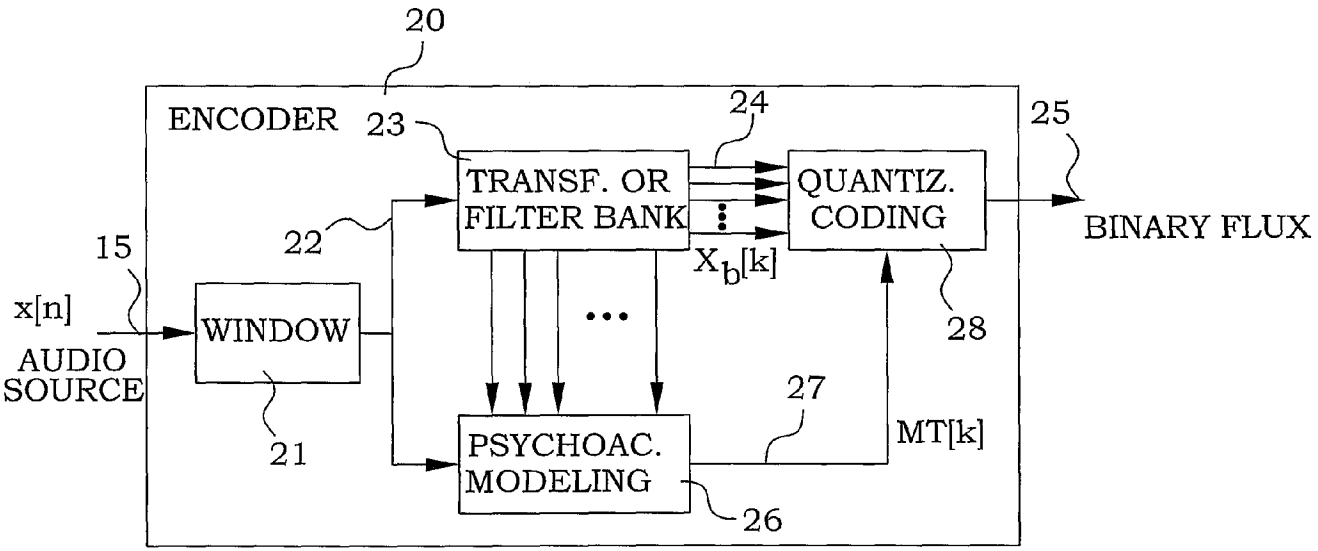
FIG. 2 is a schematic block scheme of an embodiment of an audio signal encoder.

FIG. 2 illustrates an embodiment of a typical perceptual audio encoder 20. In this particular embodiment, the perceptual audio encoder 20 is a spectral encoder based on a time-to-frequency transformer or a filter bank. An audio source 15 is received, comprising frames of audio signals.

In a typical transform encoder, the first step consists of a time-domain processing usually called windowing of the signal which results in a time segmentation of the input audio signal x[n]. Thus, a windowing section 21 receives the audio signals and provides time segmented audio signal x[n] 22.

The time segmented audio signal x[n] 22 is provided to a converter 23, arranged for converting the time domain audio signal 22 into a set of spectral coefficients of a frequency domain. The converter 23 can be implemented according to any prior-art transformer or filter bank. The details are not of particular importance for the principles of the present invention to be functional, and the details are therefore omitted from the description. The time to frequency domain transform used by the encoder could be, for example, the:

Discrete Fourier Transform (DFT), $$X[k] = \sum_{n=0}^{N-1} w[n] \times x[n] \times e^{-j2\pi\frac{nk}{N}},\ k \in \left[0, \ldots, \frac{N}{2} - 1\right],$$

where X[k] is the DFT of the windowed input signal x[n]. N is the size of the window w[n], n is the time index and k the frequency bin index.

Discrete Cosine Transform (DCT),

Modified Discrete Cosine Transform (MDCT), $$X[k] = \sum_{n=0}^{2N-1} w[n] \times x[n] \times \cos\left[\frac{\pi}{N}\left(n + \frac{N+1}{2}\right)\left(k + \frac{1}{2}\right)\right],\ k \in [0, \ldots, N-1],$$

where X[k] is the MDCT of the windowed input signal x[n]. N is the size of the window w[n], n is the time index and k the frequency bin index.

etc.

In the present embodiment, based on one of these frequency representations of the input audio signal, the perceptual audio codec aims at decompose the spectrum, or its approximation, regarding to the critical bands of the auditory system e.g. the Bark scale. This step can be achieved by a frequency grouping of the transform coefficients according to a perceptual scale established according to the critical bands.

$$X_b[k]=\{X[k]\},k\in[k_b,\ldots,k_{b+1}-1],b\in[1,\ldots,N_b],$$

with $N_b$ the number of frequency or psychoacoustical bands and b the relative index.

The output from the converter 23 is a set of spectral coefficients being a frequency representation 24 of the input audio signal.

Typically, a perceptual model is used to determine a frequency and time dependent masking of the spectral coefficients. In the present embodiment, the perceptual transform codec relies on an estimation of a Masking Threshold MT[b] in order to derive a frequency shaping function, e.g. the Scale Factors SF[b], applied to the transform coefficients $X_b[k]$ in the psychoacoustical subband domain. The scaled spectrum $Xs_b[k]$ can be defined as $$Xs_b[k]=X_b[k]\times MT[b],k\in[k_b,\ldots,k_{b+1}-1],b\in[1,\ldots,N_b].$$

To this end, in the embodiment of FIG. 2, a psychoacoustic modeling section 26 is connected to the windowing section 21 for having access to the original acoustic signal 22 and to the converter 23 for having access to the frequency representation. The psychoacoustic modeling section 26 is in the present embodiment arranged to utilize the above described estimation and outputs a masking threshold MT[k] 27.

The masking threshold MT[k] 27 and the frequency representation 24 of the input audio signal are provided to a quantizing and coding section 28. First, the masking threshold MT[k] 27 is applied on the frequency representation 24 giving a set of spectral coefficients. In the present embodiment, the set of spectral coefficients corresponds to the scaled spectrum coefficients $Xs_b[k]$ based on the frequency groupings $X_b[k]$. However, in a more general transform encoder, the scaling can also be performed on the individual spectral coefficients X[k] directly.

The quantizing and coding section 28 is further arranged for quantizing the set of spectral coefficients in any appropriate manner giving an information compression. The quantizing and coding section 28 is also arranged for coding the quantized set of spectral coefficients. Such coding takes preferably advantage of the perceptual properties and operates for masking the quantization noise in a best possible manner. The perceptual coder may thereby exploit the perceptually scaled spectrum for the coding purpose. The redundancy reduction can be thereby be performed by a quantization and coding process which will be able to focus on the most perceptually relevant coefficients of the original spectrum by using the scaled spectrum. The coded spectral coefficients together with additional side information are packed into a bitstream according to the transmission or storage standard that is going to be used. A binary flux 25 having data representing the set of spectral coefficients is thereby outputted from the quantizing and coding section 28.

Figure 3:
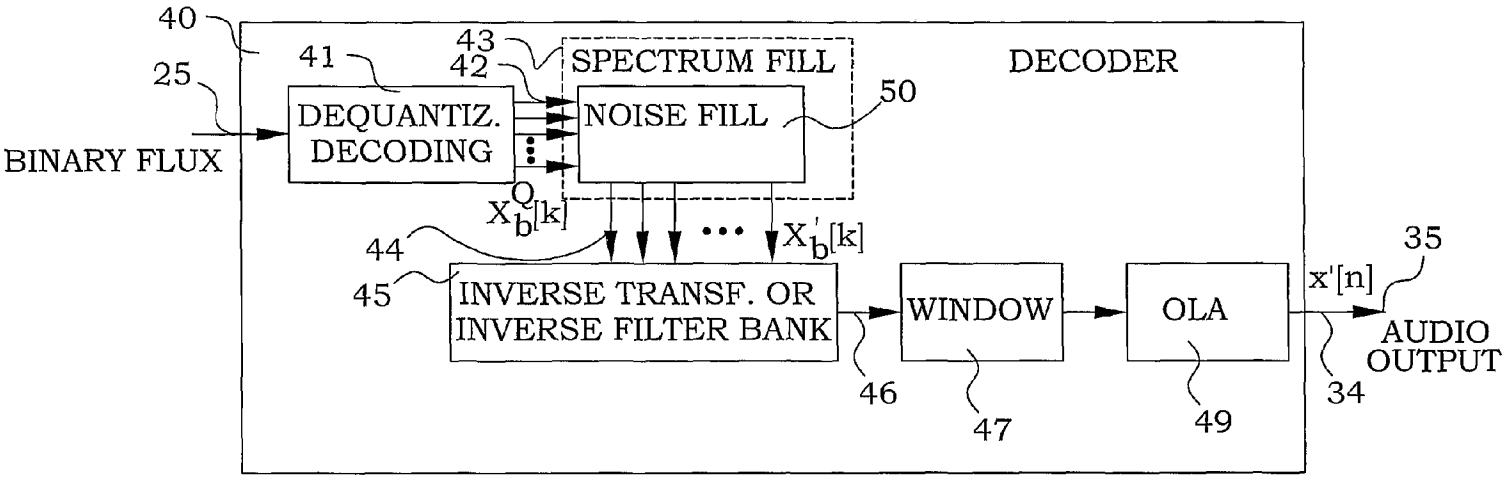
FIG. 3 is a schematic block scheme of an embodiment of an audio signal decoder.

At the decoding stage, the inverse operation is basically achieved. In FIG. 3, an embodiment of a typical perceptual audio decoder 40 is illustrated. A binary flux 25 is received, which has the properties from the encoder described here above. De-quantization and decoding of the received binary flux 25 e.g. a bitstream is performed in a spectral coefficient decoder 41. The spectral coefficient decoder 41 is arranged for decoding spectral coefficients recovered from the binary flux into decoded spectral coefficients $X^Q[k]$ of an initial set of spectral coefficients 42, possible grouped in frequency groupings $X_b^Q[k]$.

The initial set of spectral coefficients 42 is typically incomplete in that sense that it typically comprises so-called "spectral holes", which corresponds to spectral coefficients that are not received in the binary flux or at least not decoded from the binary flux. In other words, the spectral holes are non-decoded spectral coefficients $X^Q[k]$ or spectral coefficients automatically set to a predetermined value, typically zero, by the spectral coefficient decoder 41. The incomplete initial set of spectral coefficients 42 from the spectral coefficient decoder 41 is provided to a spectrum filler 43. The spectrum filler 43 is arranged for spectrum filling the initial set of spectral coefficients 42. The spectrum filler 43 in turn comprises a noise filler 50. The noise filler 50 is arranged for providing a process for noise filling of spectral holes by setting spectral coefficients in the initial set of spectral coefficients 42 not being decoded from the binary flux 25 to a definite value. As described in detail further below, according to the present invention, the spectral coefficients of the spectral holes are set equal to elements derived from the decoded spectral coefficients. The decoder 40 thus presents a specific module which allows a high-quality noise fill in the transform domain. The result from the spectrum filler 43 is a complete set 44 of reconstructed spectral coefficients $X_b'[k]$, having all spectral coefficients within a certain frequency range defined.

The complete set 44 of spectral coefficients is provided to a converter 45 connected to the spectrum filler 43. The converter 45 is arranged for converting the complete set 44 of reconstructed spectral coefficients of a frequency domain into an audio signal 46 of a time domain. The converter 45 is typically based on an inverse transformer or filter bank, corresponding to the transformation technique used in the encoder 20 (FIG. 2). In a particular embodiment, the signal 46 is provided back into the time domain with an inverse transform, e.g. Inverse MDCT-IMDCT or Inverse DFT-IDFT, etc. In other embodiments an inverse filter bank is utilized. As at the encoder side, the technique of the converter 45 as such, is known in prior art, and will not be further discussed. Finally, the overlap-add method is used to generate the final perceptually reconstructed audio signal 34 x'[n] at an output 35 for said audio signal 34. This is in the present exemplary embodiment provided by a windowing section 47 and an overlap adaptation section 49.

The above presented encoder and decoder embodiments could be provided for sub-band coding as well as for coding of entire the frequency band of interest.

Figure 4:
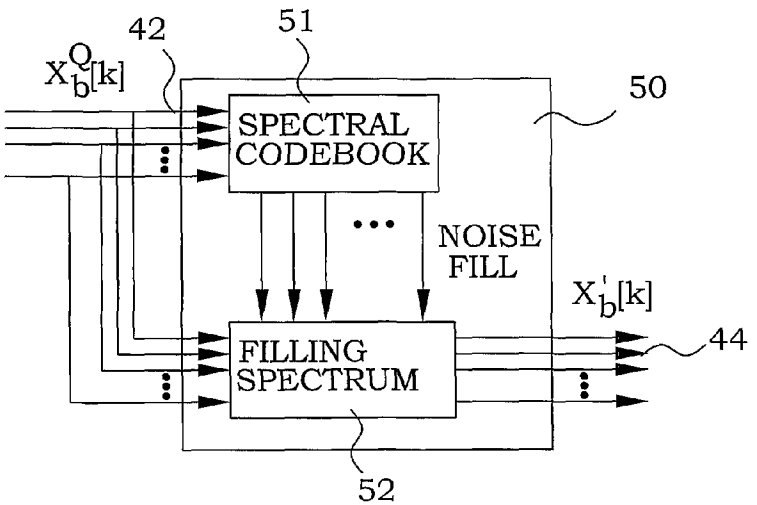
FIG. 4 is a schematic block scheme of an embodiment of a noise filler according to the present invention.

In FIG. 4, an embodiment of a noise filler 50 according to the present invention is illustrated. This particular high-quality noise filler 50 allows the preservation of the temporal structure with a spectrum filling based on a new concept called spectral noise codebook. The spectral noise codebook is built on-the-fly based on the decoded spectrum, i.e. the decoded spectral coefficients. The decoded spectrum contains the overall temporal envelope information which means that the generated, possibly random, noise from the noise codebook will also contain such information which will avoid a temporally flat noise fill, which would introduce noisy distortions.

The architecture of the noise filler of FIG. 4 relies on two consecutive sections, each one associated with a respective step. The first step, performed by a spectral codebook generator 51, consists in building a spectral codebook with elements that are provided by the decoded spectrum $X_b^Q[k]$, i.e. the decoded spectral coefficients of the initial set of spectral coefficients 42.

Then, in a filling spectrum section 52, the decoded spectrum subbands or spectral coefficients that are considered as spectral holes, are filled with the codebook elements in order to reduce the coding artifacts. This spectrum filling should preferably be considered for the lowest frequencies up to a transition frequency which can be defined adaptively. However, filling can be performed in the entire frequency range if requested. By using codebook elements, which are associated with a certain temporal structure of a present audio signal, some temporal structure preservation will be introduced also into the filled spectral coefficients.

FIG. 4 can be seen as illustrating a signal handling device for use in a perceptual spectral decoder. The signal handling device comprises an input for decoded spectral coefficients of an initial set of spectral coefficients. The signal handling device further comprises a spectrum filler connected to the input and arranged for spectrum filling of the initial set of spectral coefficients into a set of reconstructed spectral coefficients. The spectrum filler comprises a noise filler for noise filling of spectral holes by setting spectral coefficients in the initial set of spectral coefficients having a zero magnitude or being non-decoded equal to elements derived from the decoded spectral coefficients. The signal handling device also comprises an output for the set of reconstructed spectral coefficients.

Figure 5A:
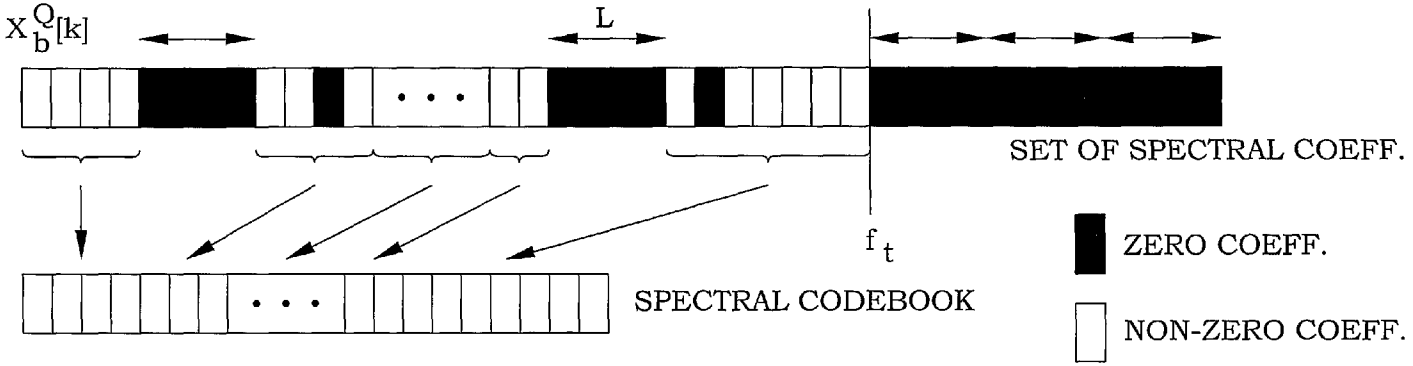
FIGS. 5A-B are illustrations of creation and utilization of spectral codebooks for noise filling purposes according to an embodiment of the present invention.
Figure 5B:
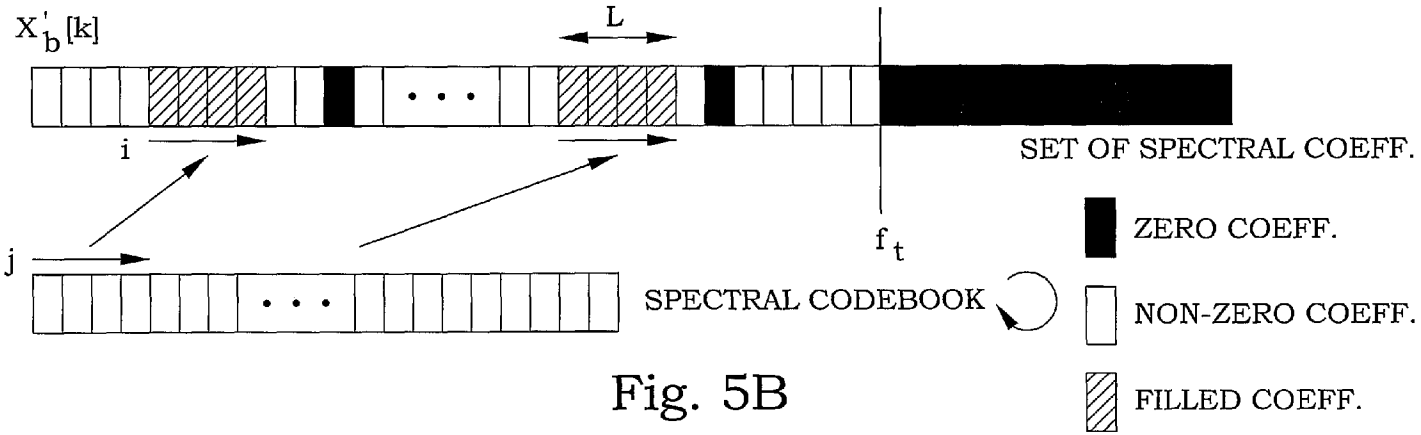

The process is schematically illustrated in FIGS. 5A-B. Here it is shown that the first step of the noise fill procedure relies on building of the spectral codebook from the spectral coefficients, e.g. the transform coefficients. This step is achieved by concatenating the perceptually relevant spectral coefficients of the decoded spectrum $X_b^Q[k]$. In the present embodiment, the decoded spectrum is divided in groups of spectral coefficients. The presented principles are, however, applicable to any such grouping. A special case is then when each spectral coefficient $X^Q[k]$ constitutes its own group, i.e. equivalent to a situation without any grouping at all. The decoded spectrum of the FIG. 5A has several series of zero coefficients or undecoded coefficients, denoted by black rectangles, which are usually called spectral holes. The groups of spectral coefficients $X_b^Q[k]$ appear typically with a certain length L. This length can be a fixed length or a value determined by the quantization and coding process.

According to the fact that spectral holes resulting from the quantization and coding process are not perceptually relevant, the spectral codebook is in this embodiment made from the groups of spectral coefficients $X_b^Q[k]$ or equivalently spectral subbands, which have not only zeros. For example, a subband of length L with Z zeros ($Z<L$) will in this embodiment be part of the codebook since a part of the subband has been encoded, i.e. quantized. In this way the codebook size is defined adaptively to the perceptually relevant content of the input spectrum.

In other embodiments, other selection criteria may be used when generating the spectral codebook. One possible criterion to be included in the spectral codebook could be that none of the spectral coefficients of a certain group of spectral coefficients $X_b^Q[k]$ is allowed to be undefined or equal to zero. This reduces the selection possibilities within the spectral codebook, but at the same time it ensures that all elements of the spectral codebook carry some temporal structure information. As anyone skilled in the art realizes, there are unlimited variations of possible criterions for selecting appropriate elements derived from the decoded spectral coefficients.

When a spectral hole is requested to be filled, it is in this embodiment proposed to fill the spectral holes by elements from the spectral codebook. This is performed in order to reduce typical quantization and coding artefacts. One improvement of the present invention compared to prior art relies on the fact that the spectral filling is achieved with parts of the perceptually relevant spectrum itself and then, allows the preservation of the temporal structure of the original signal. Typically, white noise injection proposed by the state-of-the-art noise fill schemes [1] does not meet the important requirement of preservation of the temporal structure, which means that pre-echo artefacts may be produced. At the contrary, the spectral filling according to the present embodiment will not introduce pre-echo artefacts while still reducing the quantization and coding artefacts.

As it is shown in FIG. 5B, the spectral codebook elements are used to fill the spectral holes, e.g. succession of Z=L zeros, preferably up to a transition frequency. The transition frequency may be defined by the encoder and then transmitted to the decoder or determined adaptively by the decoder from the audio signal content. It is then assume that the transition frequency is defined at the decoder in the same way as it would have been done by the encoder, e.g. based on the number of coded coefficients per subband.

Since the total length of all spectral holes can be larger than the length of the spectral codebook, the same codebook elements may have to be used for filling several spectral holes.

The choice of the elements from the spectral codebook used for filling can be done by following one or several criteria. One criterion, which corresponds to the embodiment illustrated in FIG. 5B, is to use the elements of the spectral codebook in index order, preferably starting at the low frequency end. If the indices of the set of spectral coefficients are denoted by i and the indices of the spectral codebook are denoted by j, couples (i,j) can represent the filling strategy. The index order approach can then be expressed as blindly fill the spectral holes by increasing the codebook index j as much as the index i. This is used to cover all the spectral holes. If there are more spectral holes than elements in the spectral codebook, the use of the spectral codebook elements may start from the beginning again, i.e. by a cyclic use of the spectral codebook, when all elements of the spectral codebook are utilized.

Other criterions could also be used to define the couples (i,j), for instance, the spectral distance e.g. frequency, between the spectral hole coefficients and the codebook elements. In this manner, it can be assured e.g. that the utilized temporal structure is based on spectral coefficients associated with a frequency not too far from the spectral hole to be filled. Typically, it is believed that it is more appropriate to fill spectral holes with elements associated with a frequency that is lower than the frequency of the spectral hole to be filled.

Another criterion is to consider the energy of the spectral hole neighbours so that the injected codebook elements smoothly will fit to the recovered encoded coefficients. In other words, the noise filler is arranged to select the elements from the spectral codebook based on an energy of a decoded spectral coefficient adjacent to a spectral hole to be filled and an energy of the selected element.

A combination of such criteria could also be considered.

In the above embodiment, the spectral codebook comprises decoded spectral coefficients from a present frame of the audio signal. There are also temporal dependencies passing the frame boundaries. In alternative embodiment, in order to utilize such interframe temporal dependencies, it would be possible to e.g. save parts of a spectral codebook from one frame to another. In other words, the spectral codebook may comprise decoded spectral coefficients from at least one of a past frame and a future frame.

The elements of the spectral codebook can, as indicated in the above embodiments, correspond directly to certain decoded spectral coefficients. However, it is also possible to arrange the noise filler to further comprise a postprocessor. The postprocessor is arranged for postprocessing the elements of the spectral codebook. This leads to that the noise filler has to be arranged for selecting the elements from the postprocessed spectral codebook. In such a way, certain dependencies, in frequency and/or temporal space, can be smoothed, reducing the influence of e.g. quantizing or coding noise.

The use of a spectral codebook is a practical implementation of the arranging of setting spectral holes equal to elements derived from the decoded spectral coefficients. However, simple solutions may also be realized in alternative manners. Instead of explicitly collect the candidates for filling elements in a separate codebook, the selection and/or derivation of elements to be used for filling spectral holes can be performed directly from the decoded spectral coefficients of the set.

Figure 6:
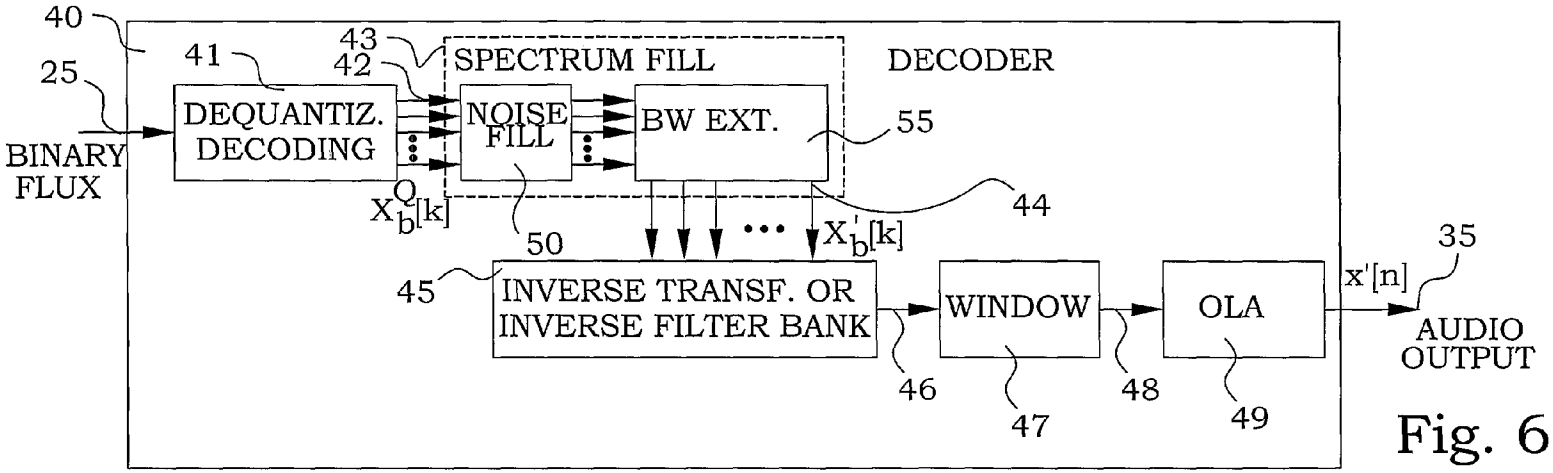
FIG. 6 is a schematic block scheme of an embodiment of a decoder according to the present invention.

In preferred embodiments, the spectrum filler of the decoder is further arranged for providing bandwidth extension. In FIG. 6, an embodiment of a decoder 40 is illustrated, in which the spectrum filler 43 additionally comprises a bandwidth extender 55. The bandwidth extender 55, as such known in prior art, increases the frequency region in which spectral coefficients are available at the high frequency end. In a typical situation, the recovered spectral coefficients are provided mainly below a transition frequency. Any spectral holes are there filled by the above described noise filling. At frequencies above the transition frequency, typically none or a few recovered spectral coefficients are available. This frequency region is thus typically unknown, and of rather low importance for the perception. By extending the available spectral coefficients also within this region, a full set of spectral coefficients suitable for e.g. inverse transforming can be provided. As a summary, noise filling is typically performed for frequencies below the transition frequency and the bandwidth extension is typically performed for frequencies above the transition frequency.

Figure 7:
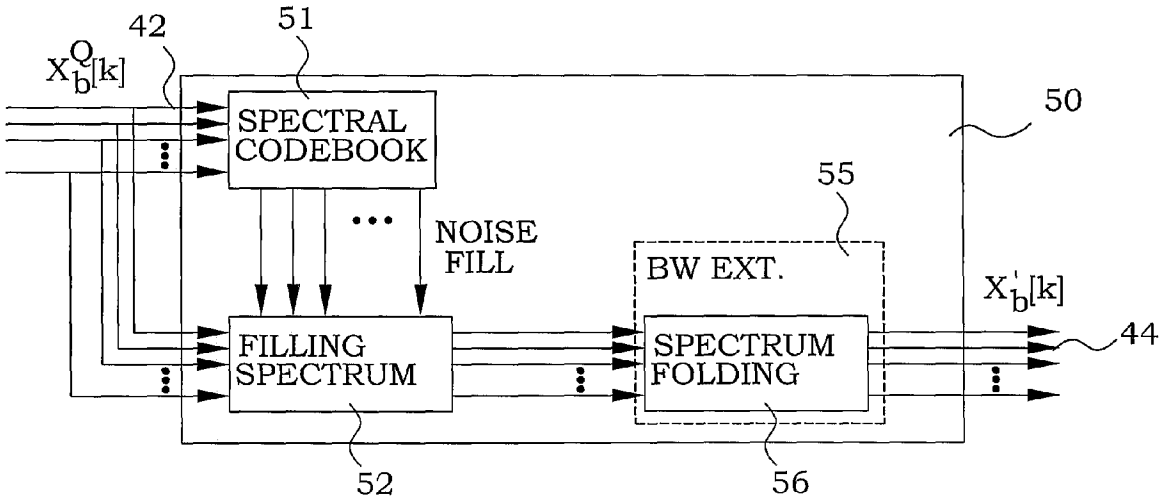
FIG. 7 is a schematic block scheme of another embodiment of a noise filler according to the present invention.

In a particular embodiment, illustrated in FIG. 7, the bandwidth extender 55 is considered as a part of the noise filler 50. In this particular embodiment, the bandwidth extender 55 comprises a spectrum folding section 56, in which high-frequency spectral coefficients are generated by spectral folding in order to build a full-bandwidth audio signal. In other words, the process synthesizes a high-frequencies spectrum from the filled spectrum in the present embodiment by spectral folding based on the value of the transition frequency.

Figure 8A:
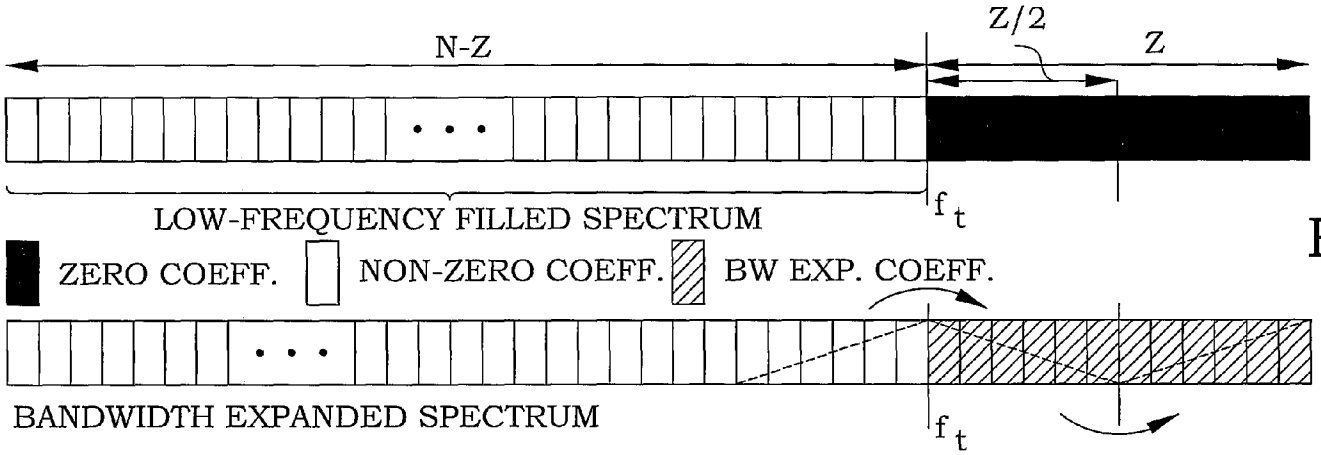
FIGS. 8A-B are illustrations of embodiments of bandwidth expansion according to an embodiment of a spectrum fold approach according to the present invention.

An embodiment of a full-bandwidth generation is described by FIG. 8A. It is based on a spectral folding of the spectrum below the transition frequency to the high-frequency spectrum, i.e. basically zeros above the transition frequency. To do so, the zeros at frequencies over the transition frequency are filled with the low-frequency filled spectrum. In the present embodiment, a length of the low-frequency filled spectrum equal to half the length of the high-frequency spectrum to be filled is selected from frequencies just below the transition frequency. Then, a first spectral copy is achieved with respect to a point of symmetry defined by the transition frequency. Finally, the first half part of the high-frequency spectrum is then also used to generate the second half part of the high-frequency spectrum by an additional folding.

This procedure can be seen as a specific implementation of the general method which can be described as follows. The spectrum above the transition frequency (Z transform coefficients) is divided into U ($U \geqq 2$) spectral units or blocks depending on the signal harmonic structure (speech signal for instance) or any other suitable criterion. Indeed, if the original signal has a strong harmonic structure then it is appropriated to reduce the length of the spectrum part used for the folding (increase U) in order to avoid annoying artefacts.

In an alternative embodiment, described in FIG. 8B, a section of the low frequency filled spectrum just below the transition frequency is also here used for spectrum folding. If the intended bandwidth extension Z is smaller than or equal to half the available low-frequency filled spectrum (N−Z)/2, a section of the low frequency filled spectrum corresponding to the length of the high-spectrum to be filled is selected and folded onto the high-frequency around the transition frequency. However, if the intended bandwidth extension Z is larger than half the available low-frequency filled spectrum (N−Z)/2, i.e. in case that $N<3*Z$, only half the low frequency filled spectrum is selected and folded in the first place. Then, a spectrum range from the just folded spectrum is selected to cover the rest of the high-frequency range. If necessary, i.e. if $N<2*Z$, this folding can be repeated with a third copy, a fourth copy, and so on, until the entire high-frequency range is covered to ensure spectral continuity and a full-bandwidth signal generation.

Figure 8B:
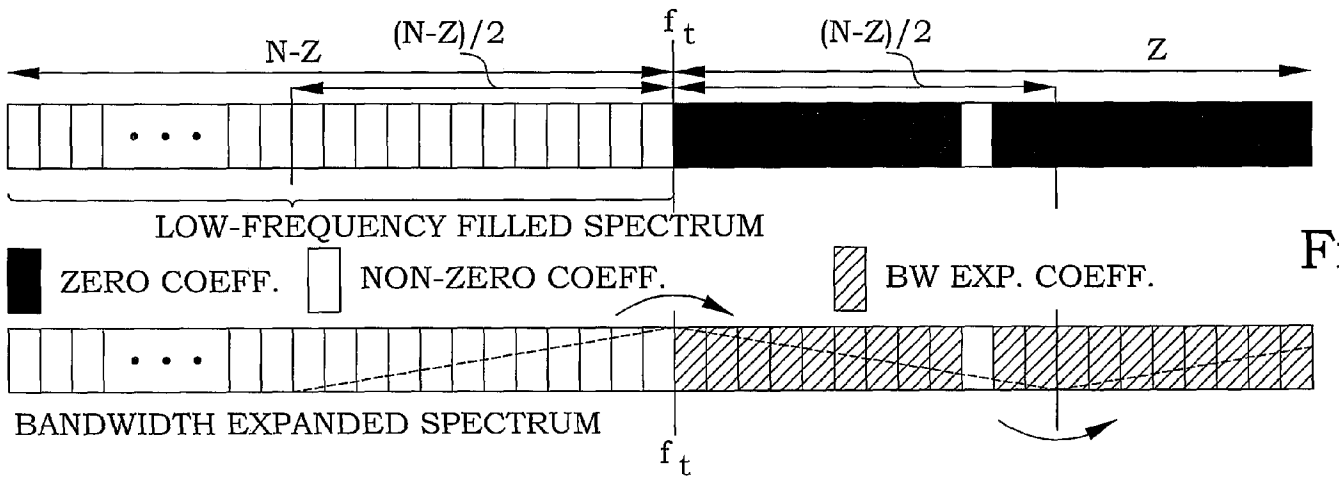

In case the high-frequency spectrum, above the transition frequency, is not completely full of zero or undefined coefficients, which means that some transform coefficients indeed have been perceptually encoded or quantized, then, the spectral folding should preferably not replace, modify or even delete these coefficients, as indicated in FIG. 8B.

Figure 9:
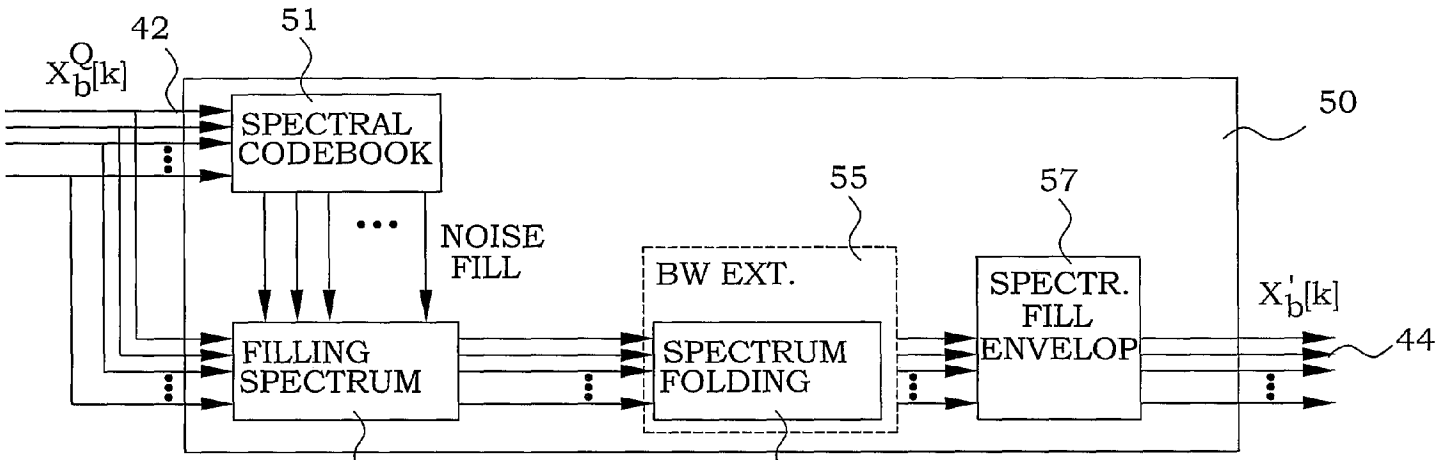
FIG. 9 is a schematic block scheme of yet another embodiment of a noise filler according to the present invention.

In FIG. 9, an embodiment of a decoder 40 also presenting application of the spectral fill envelope is illustrated. To this end, the noise filler 50 comprises a spectral fill envelope section 57. The spectral fill envelope section 57 is arranged for applying the spectral fill envelope to the filled and folded spectrum over all subbands so that the final energy of the decoded spectrum $X'_b[k]$ will approximate the energy of the original spectrum $X_b[k]$, i.e. in order to conserve an initial energy. This is also applicable when the noise filling is performed in a normalized domain.

In one embodiment, this is done by using a subband gain correction which can be written as:

$$X'_b[k] = X_b^Q[k] \times 10^{\frac{G[b]}{20}},\ k \in [k_b, \ldots, k_{b+1}-1],\ b \in [1, \ldots, N_b],$$

where the gains G[b] in dB are given by the logarithmic value of the average quantization error for each subband b $$G[b] = 10 \times \log_{10}\left(\frac{1}{(k_{b+1}-k_b)} \sum_{k=k_b}^{k_{b+1}-1} \left|X_b[k] - X_b^Q[k]\right|^2\right).$$

To do so, the energy levels of the original spectrum and/or the noise floor e.g. the envelope G[b], should have been encoded and transmitted by the encoder to the decoder as side information.

This way, the signal like estimated envelope, G[b] for the subbands above the transition frequency, is able to adapt the energy of the filled spectrum after spectral folding to the initial energy of the original spectrum, as it is described by the equation further above.

Figure 10:
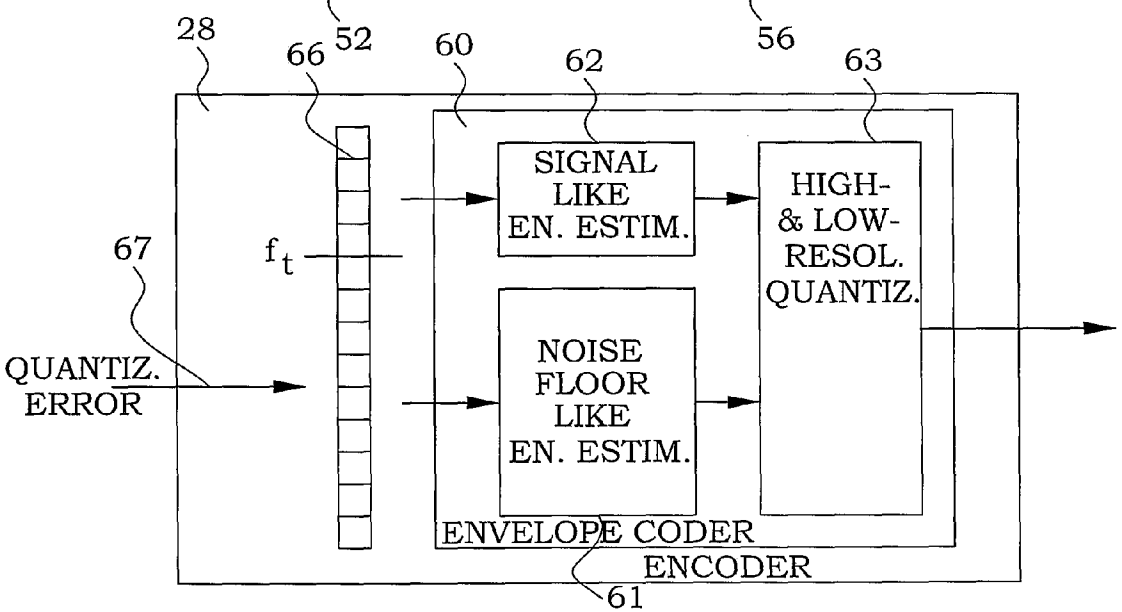
FIG. 10 is a schematic block scheme of en encoder having an envelope coder according to an embodiment of the present invention.

In a particular embodiment, a combination of a signal and noise floor like energy estimation, in a frequency dependant manner, is made in order to build an appropriate envelope to be used after the spectral fill and folding. FIG. 10 illustrate a part of an encoder 20 used for such purposes. Spectral coefficients 66, e.g. transform coefficients, are input to an envelope coding section. Quantization errors 67 are introduced by the quantization of the spectral coefficients. The envelope coding section 60 comprising two estimators; a signal like energy estimator 62 and a noise floor like energy estimator 62.

The estimators 62, 61 are connected to a quantizer 63 for quantization of the energy estimation outputs.

As can be seen in FIG. 10, rather than only using a signal like estimated envelope, it is in the present embodiment proposed to use a noise floor like energy estimation for the subbands below the transition frequency. The main difference with the signal like energy estimation, of the equations above, relies on the computation so that the quantization error will be flattened by using a mean over the logarithmic values of its coefficients and not a logarithmic value of the averaged coefficients per subband. The combination of signal and noise floor like energy estimation at the encoder is used to build an appropriate envelope, which is applied to the filled spectrum at the decoder side.

Figure 11:
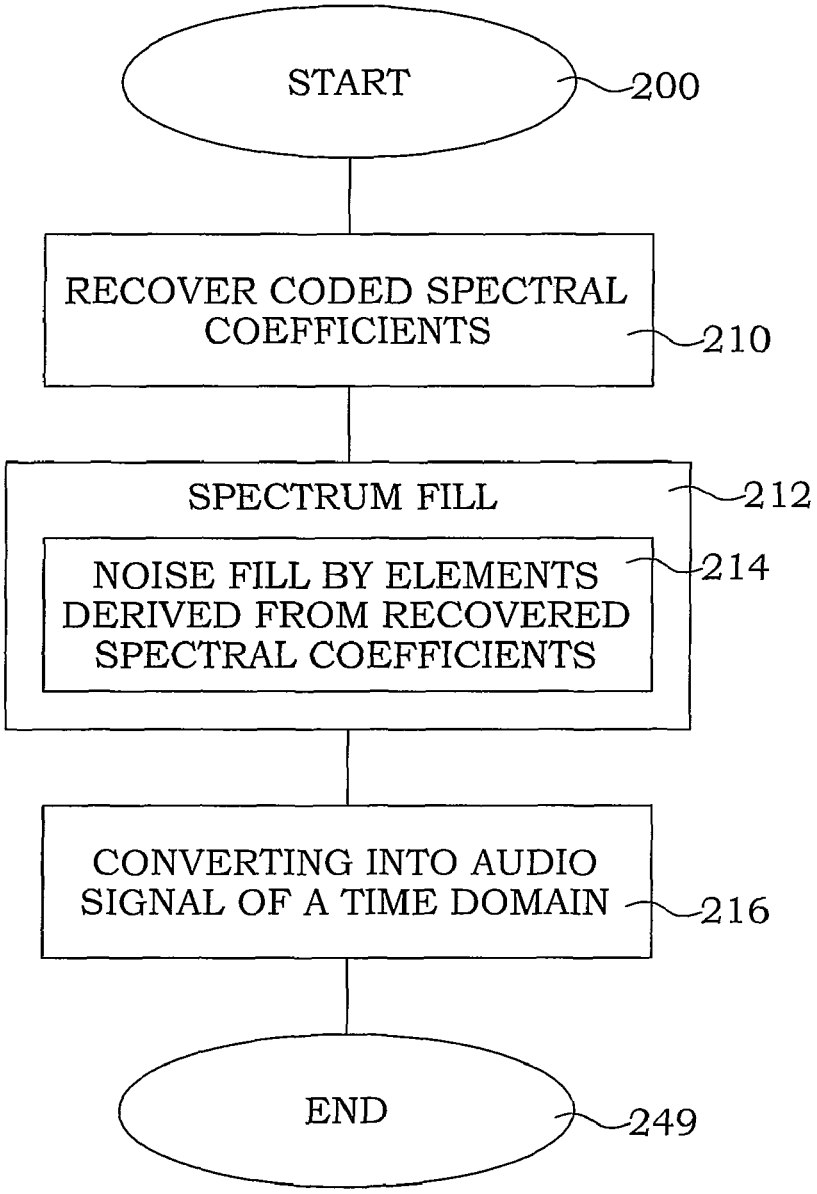
FIG. 11 is a flow diagram of steps of an embodiment of a decoding method according to the present invention.

FIG. 11 illustrates a flow diagram of steps of an embodiment of a decoding method according to the present invention. The method for perceptual spectral decoding starts in step 200. In step 210, spectral coefficients recovered from a binary flux are decoded into decoded spectral coefficients of an initial set of spectral coefficients. In step 212, spectrum filling of the initial set of spectral coefficients is performed, giving a set of reconstructed spectral coefficients. The set of reconstructed spectral coefficients of a frequency domain is converted in step 216 into an audio signal of a time domain. Step 212, in turn comprises a step 214, in which spectral holes are noise filled by setting spectral coefficients in the initial set of spectral coefficients not being decoded from the binary flux equal to elements derived from the decoded spectral coefficients. The procedure is ended in step 249.

Preferred embodiments of the method are to be found among the procedures described in connection with the devices further above.

The spectrum fill part of the procedure of FIG. 11 can also be considered as a separate signal handling method that is generally used within perceptual spectral decoding. Such a signal handling method involves the central noise fill step and steps for obtaining an initial set of spectral coefficients and for outputting a set of reconstructed spectral coefficients.

Figure 12:
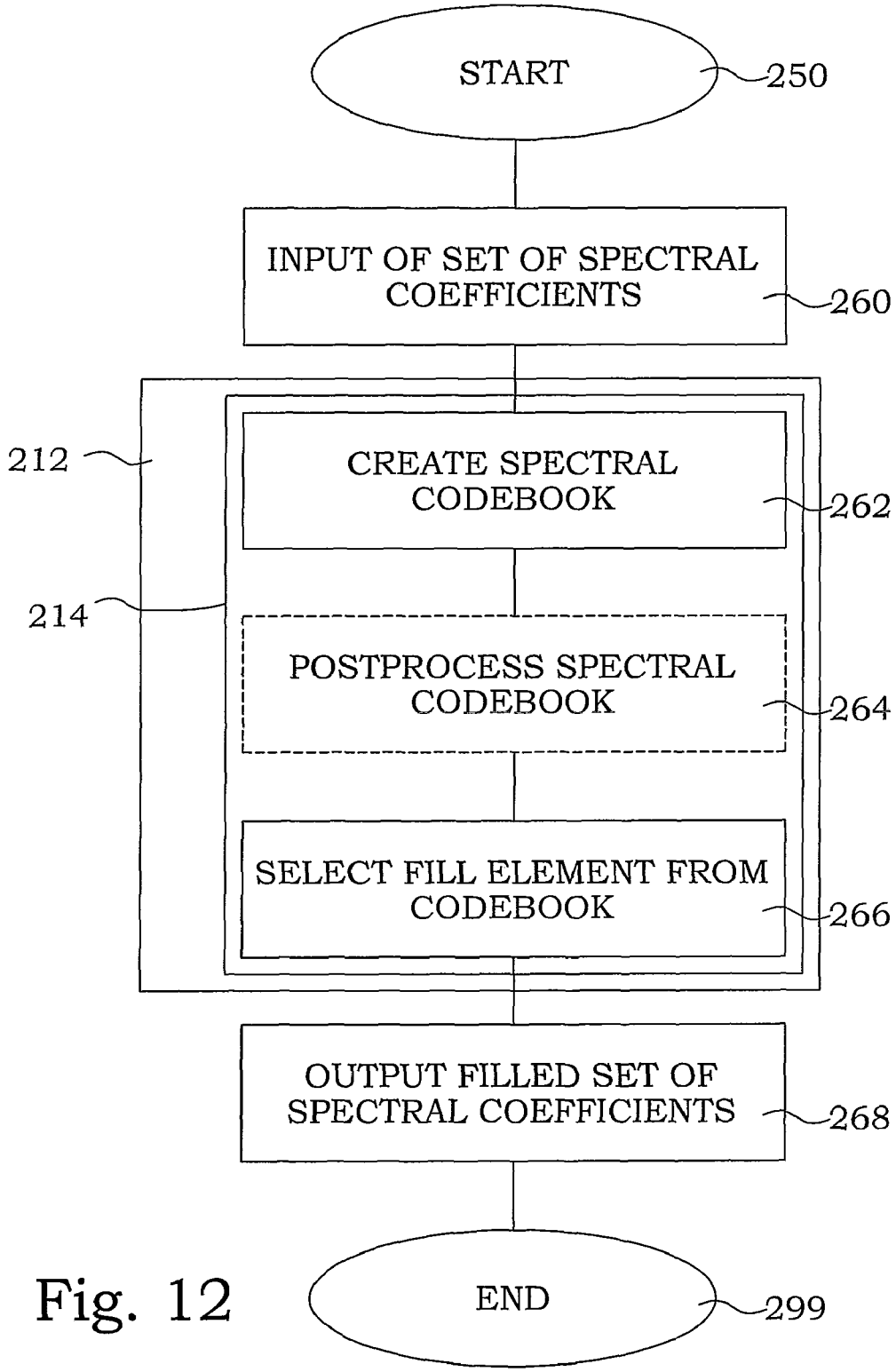
FIG. 12 is a flow diagram of steps of an embodiment of a signal handling method according to the present invention.

In FIG. 12, a flow diagram of steps of a preferred embodiment of such a noise fill method according to the present invention is illustrated. This method may thus be used as a part of the method illustrated in FIG. 11. The method for signal handling starts in step 250. In step 260, an initial set of spectral coefficients is obtained. Step 270, being a spectrum filling step comprises a noise filling step 272, which in turn comprises a number of substeps 262-266. In step 262, a spectral codebook is created from decoded spectral coefficients. In step 264, which may be omitted, the spectral codebook is postprocessed, as described further above. In step 266, fill elements are selected from the codebook to fill spectral holes in the initial set of spectral coefficients. In step 268, a set of recovered spectral coefficients is outputted. The procedure ends in step 299.

The invention described here above has many advantages, some of which will be mentioned here. The noise fill according to the present invention provides a high quality compared e.g. to typical noise fill with standard Gaussian white noise injection. It preserves the original signal temporal envelope. The complexity of the implementation of the present invention is very low compared solutions according to state of the art. The noise fill in the frequency domain can e.g. be adapted to the coding scheme under usage by defining an adaptive transition frequency at the encoder and/or at the decoder side.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

REFERENCES

[1] J. D. Johnston, "Transform coding of audio signals using perceptual noise criteria", IEEE J. Select. Areas Commun., Vol. 6, pp. 314-323, 1988.

[2] J. Herre, "Temporal Noise Shaping, Quantization and Coding Methods in Perceptual Audio Coding: A tutorial introduction", AES 17th Int. conf. on High Quality Audio Coding, 1997.

[3] 3GPP TS 26.404 V 6.0.0 (2004-09), "Enhanced aacPlus general audio codec—encoder SBR part (Release 6)", 2004.

The invention claimed is:

1. Method for perceptual spectral decoding, comprising the steps of:

decoding spectral coefficients recovered from a binary flux into decoded spectral coefficients of an initial set of spectral coefficients;

spectrum filling of said initial set of spectral coefficients into a set of reconstructed spectral coefficients;

said spectrum filling comprising noise filling of spectral holes by setting spectral coefficients in said initial set of spectral coefficients not being decoded from said binary flux equal to elements derived from said decoded spectral coefficients; and converting said set of reconstructed spectral coefficients of a frequency domain into an audio signal of a time domain, characterised in that said noise filling in turn comprises creation of a spectral codebook dependent on said decoded spectral coefficients, whereby said noise filling of spectral holes comprises setting of spectral coefficients in said initial set of spectral coefficients equal to elements selected from said spectral codebook according to at least one criterion;

said elements are selected from said spectral codebook in index order as a circular buffer, starting from a low frequency end.

2. Method according to claim 1, wherein said spectral codebook comprises elements based on perceptually relevant decoded spectral coefficients from a present frame.

3. Method according to claim 1, wherein said spectral codebook comprises elements based on perceptually relevant decoded spectral coefficients from at least one of a past frame and a future frame.

4. Method according to claim 1, wherein said noise filling further comprises postprocessing of said spectral codebook, whereby said elements are selected from said postprocessed spectral codebook.

5. Method according to claim 1, wherein said spectrum filling further comprises bandwidth extension.

6. Method according to claim 5, wherein said noise filling is performed for frequencies below a transition frequency and said bandwidth extension is performed for frequencies above said transition frequency.

7. Method according to claim 5, wherein said bandwidth extension comprises spectral folding.

8. Method according to claim 1, wherein said noise filling is performed in a normalized domain.

9. Method according to claim 8, further comprising the step of applying a spectral fill envelope on said set of spectral coefficients in order to conserve an initial energy.

10. Method according to claim 1, wherein said converting comprises inverse transformation using at least one of an inverse transform and an inverse filter bank.

11. Method for signal handling in perceptual spectral decoding, comprising the steps of:

obtaining decoded spectral coefficients of an initial set of spectral coefficients;

spectrum filling of said initial set of spectral coefficients into a set of reconstructed spectral coefficients;

said spectrum filling comprising noise filling of spectral holes by setting spectral coefficients in said initial set of spectral coefficients having a zero magnitude or being non-decoded equal to elements derived from said decoded spectral coefficients; and outputting said set of reconstructed spectral coefficients, characterised in that said noise filling in turn comprises creation of a spectral codebook dependent on said decoded spectral coefficients, whereby said noise filling of spectral holes comprises setting of spectral coefficients in said initial set of spectral coefficients equal to elements selected from said spectral codebook according to at least one criterion;

said elements are selected from said spectral codebook in index order as a circular buffer, starting from a low frequency end.

12. Perceptual spectral decoder comprising:

an input for a binary flux;

a spectral coefficient decoder arranged for decoding spectral coefficients recovered from said binary flux into decoded spectral coefficients of an initial set of spectral coefficients;

a spectrum filler connected to said spectral coefficient decoder and arranged for spectrum filling of said set of spectral coefficients;

said spectrum filler comprising a noise filler for noise filling of spectral holes by setting spectral coefficients in said initial set of spectral coefficients not being decoded from said binary flux equal to elements derived from said decoded spectral coefficients; and a converter connected to said spectrum filler and arranged for converting said set of reconstructed spectral coefficients of a frequency domain into an audio signal (34) of a time domain; and an output for said audio signal characterised in that said noise filler in turn comprising a spectral codebook generator;

said spectral codebook generator being arranged for creating a spectral codebook from said decoded spectral coefficients;

said noise filler being arranged for filling said spectral holes with elements selected from said spectral codebook according to at least one criterion; and said noise filler being further arranged to select said elements from said spectral codebook in index order as a circular buffer, starting from a low frequency end.

13. Perceptual spectral decoder according to claim 12, wherein said spectral codebook generator is arranged for creating said spectral codebook to comprise elements based on perceptually relevant decoded spectral coefficients from a present frame.

14. Perceptual spectral decoder according to claim 12, wherein said spectral codebook generator is arranged for creating said spectral codebook to comprise elements based on perceptually relevant decoded spectral coefficients from at least one of a past frame and a future frame.

15. Perceptual spectral decoder according to claim 12, wherein said noise filler further comprises a postprocessor arranged for postprocessing said spectral codebook, whereby said noise filler being arranged for selecting said elements from said postprocessed spectral codebook.

16. Perceptual spectral decoder according to claim 12, wherein said spectrum filler further comprises a bandwidth extender.

17. Perceptual spectral decoder according to claim 16, wherein said noise filler is arranged for performing noise filling for frequencies below a transition frequency and said bandwidth extender being arranged for extending a bandwidth for frequencies above said transition frequency.

18. Perceptual spectral decoder according to claim 16, wherein said bandwidth extender comprises a spectral folding section.

19. Perceptual spectral decoder according to claim 12, wherein said noise filler is arranged to operate in a normalized domain.

20. Perceptual spectral decoder according to claim 19, further comprising a spectral fill envelope applier arranged for applying a spectral fill envelope on said set of spectral coefficients in order to conserve an initial energy.

21. Perceptual spectral decoder according to claim 12, wherein said converter comprises at least one of an inverse transform section and an inverse filter bank.

22. Signal handling device for use in a perceptual spectral decoder, comprising:

an input for decoded spectral coefficients of an initial set of spectral coefficients;

a spectrum filler connected to said input and arranged for spectrum filling of said initial set of spectral coefficients into a set of reconstructed spectral coefficients;

said spectrum filler comprising a noise filler for noise filling of spectral holes by setting spectral coefficients in said initial set of spectral coefficients having a zero magnitude or being non-decoded equal to elements derived from said decoded spectral coefficients; and an output for said set of reconstructed spectral coefficients, characterised in that said noise filler in turn comprising a spectral codebook generator;

said spectral codebook generator being arranged for creating a spectral codebook from said decoded spectral coefficients;

said noise filler being arranged for filling said spectral holes with elements selected from said spectral codebook according to at least one criterion; and said noise filler being further arranged to select said elements from said spectral codebook in index order as a circular buffer, starting from a low frequency end.

* * * * *

UNITED STATES PATENT AND TRADEMARK OFFICE

CERTIFICATE OF CORRECTION

PATENT NO. : 8,370,133 B2
APPLICATION NO. : 12/675290
DATED : February 5, 2013
INVENTOR(S) : Taleb et al.

It is certified that error appears in the above-identified patent and that said Letters Patent is hereby corrected as shown below:

On the Title Page, in item (56), under "OTHER PUBLICATIONS", in Column 2, Line 1, delete "in in" and insert -- in --, therefor.

In the Drawings:

In Fig. 9, Sheet 6 of 8, for Tag "57", in Line 3, delete "ENVELOP" and insert -- ENVELOPE --, therefor.

In the Claims:

In Column 13, Line 46, in Claim 12, delete "signal (34)" and insert -- signal --, therefor.

Signed and Sealed this
Tenth Day of September, 2013

Teresa Stanek Rea
*Acting Director of the United States Patent and Trademark Office*